US007617624B1

(12) United States Patent
Chen

(10) Patent No.: US 7,617,624 B1
(45) Date of Patent: Nov. 17, 2009

(54) MUSICAL WATER TANK

(76) Inventor: Tsan-Yao Chen, 2-1 Fl, No. 76, Sec. 3, Hsinsheng North Road, Taipei City (TW)

( * ) Notice: Subject to any disclaimer, the term of this patent is extended or adjusted under 35 U.S.C. 154(b) by 0 days.

(21) Appl. No.: 12/326,896

(22) Filed: Dec. 3, 2008

(51) Int. Cl.
*G09F 19/00* (2006.01)

(52) U.S. Cl. ..... 40/406; 40/409; 40/426

(58) Field of Classification Search ..... 40/406–410, 40/426

See application file for complete search history.

(56) References Cited

U.S. PATENT DOCUMENTS 5,313,727 A * 5/1994 Murray, Jr. ..... 40/410
6,282,820 B1 * 9/2001 White et al. ..... 40/410
2002/0100195 A1 * 8/2002 Hsu ..... 40/409
2003/0014889 A1 * 1/2003 Zhao ..... 40/406

* cited by examiner

*Primary Examiner*—Cassandra Davis
(74) *Attorney, Agent, or Firm*—Leong C. Lei

(57) ABSTRACT

The musical water tank contains, from top to bottom, a tank filled with different fluids, a nozzle member, a washer, a partitioning platform having physically insulated top and bottom halves, and a base having musical sound and light generation mechanism. A pump member and a driving member are aligned and positioned in the top and bottom halves of the partitioning platform, respectively. A motor of the driving member spins a first disc which indirectly and magnetically engages a second disc on an axle of the pump member to spin. The axle of the pump member drives a vane wheel to pump fluid upward into the nozzle member. The fluid is then ejected out of a number of nozzles of the nozzle member into the tank to create visually appealing streams and bubbles, accompanied by the musical sound the lighting effects from the base.

4 Claims, 8 Drawing Sheets

MUSICAL WATER TANK

TECHNICAL FIELD OF THE INVENTION

The present invention generally relates to music boxes or similar devices, and more particularly to a music box integrated with a fluid-filled tank.

DESCRIPTION OF THE PRIOR ART

A musical box is a container such as a jewelry box that has a built-in automatic musical instrument that produces sounds by the use of a set of pins placed on a revolving cylinder or disc so as to strike the tuned teeth of a steel comb.

A derivative of the music box has a globe filled with water or some transparent fluid (hereinafter water tank) positioned on the music box for decorative or entertainment purpose. An axle is extended from the music box into the water tank that is rotated along with the revolving cylinder or disc. A character such as a ballerina inside the globe attached to the axle therefore is rotated as well, accompanying the musical sound produced by the music box.

Since the axle penetrates the globe and submerges in the water, usually a water-proof washer is provided at where the axle enters the globe so as to prevent water leakage.

However, this configuration has a number of disadvantages. First, if the washer is not tight enough, leakage is still inevitable and the music box is damaged. On the other hand, if the washer is too tight, the axle could not spin smoothly and sometimes would stop entirely. Further more, the axle is rotated at a single speed which cannot be dynamically changed to match the rhythm of the delivered musical sound, making the water tank less appealing.

SUMMARY OF THE INVENTION

A novel musical water tank is therefore provided herein, whose electrical parts are physically separated from, but magnetically coupled to, the mechanical parts so that the electrical parts will never be damaged by the water tank leakage.

The musical water tank contains a tank filled with fluids of different specific weights, a nozzle member, a washer, a partitioning platform having a top half and a bottom half physically insulated from each other, and a base having musical sound and light generation mechanism, positioned in this order from top to bottom.

A pump member and a driving member are aligned and positioned in the top and bottom halves of the partitioning platform, respectively. A motor of the driving member spins a first disc which indirectly and magnetically engages a second disc on an axle of the pump member to spin. The axle of the pump member drives a vane wheel to spin and thereby to pump heavier fluid upward into the nozzle member. The fluid is then ejected out of a number of nozzles of the nozzle member into the tank to create visually appealing streams and bubbles, accompanied by the musical sound and lighting effects delivered from the base.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
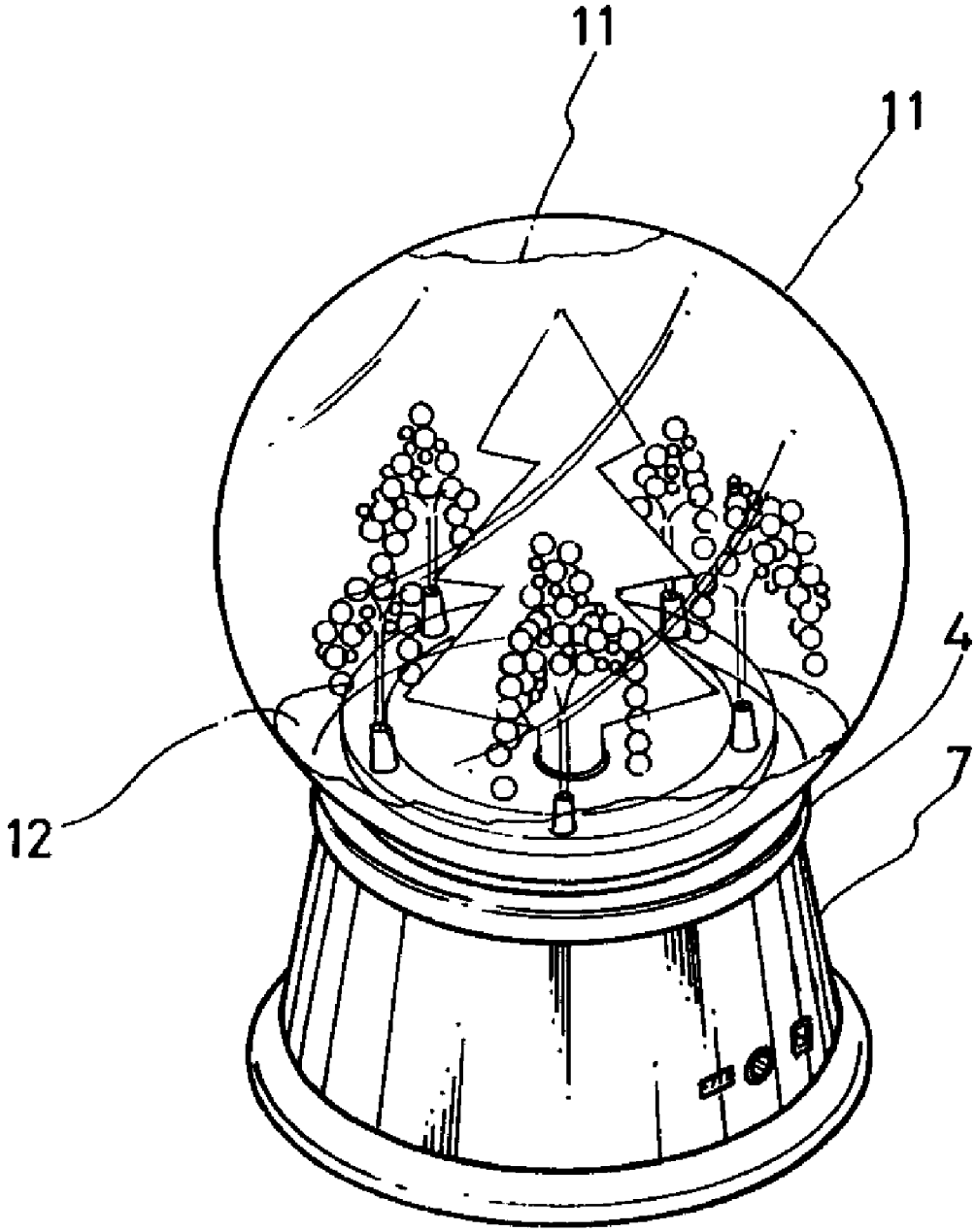
FIG. 1 is a perspective diagram showing a musical water tank according to an embodiment of the present invention.
Figure 2:
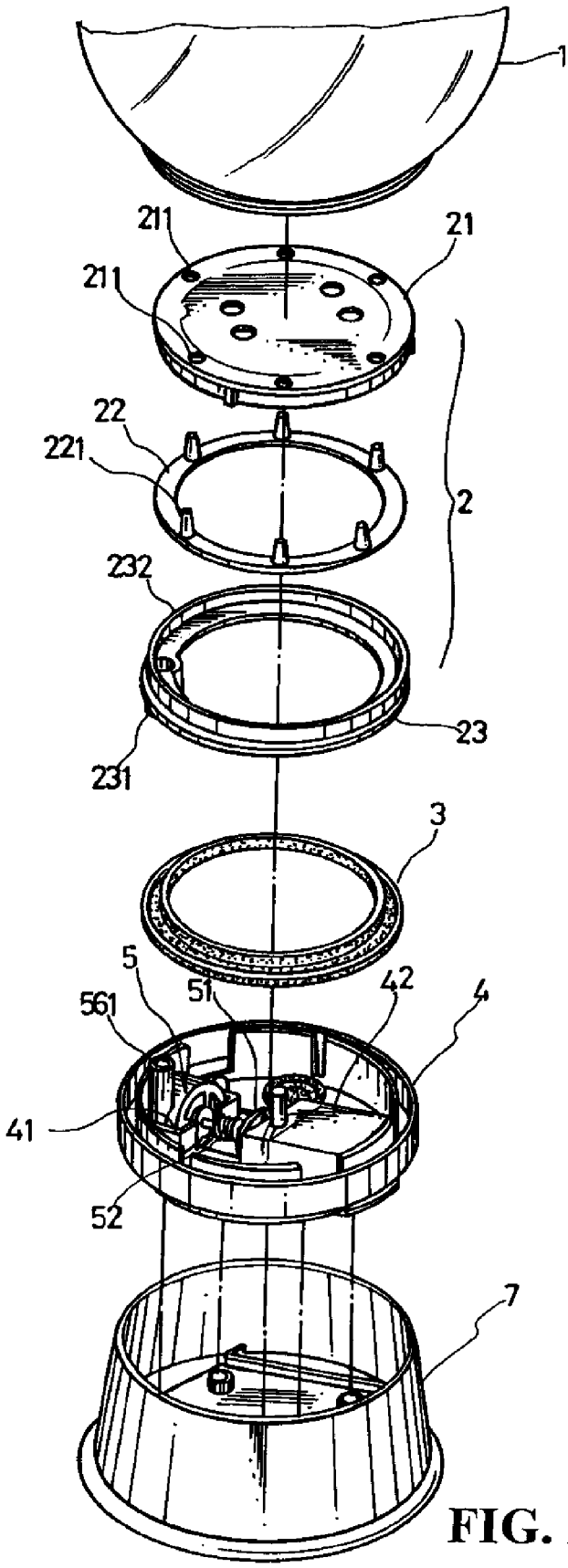
FIG. 2 is a perspective and exploded diagram showing the various components of the musical water tank of FIG. 1.

As shown in FIGS. 1 and 2, a musical water tank according to an embodiment of the present invention contains a hollow and transparent spherical tank 1, a circular nozzle member 2, a ring washer 3, a partitioning platform 4, and a base 7, positioned in this order from top to bottom.

The tank 1 is filled with at least two types of fluids 11 and 12 of different specific weights and colors so that they are not mixed together and the heavier fluid 12 sinks to the lower part of the tank 1. The tank 1 has a bottom opening (not numbered) that is sealed the partitioning platform 4 with the ring washer 3 in between to prevent the fluids 11 and 12 from leaking. The nozzle member 2 is supported by the partitioning platform 4 to locate at the bottom opening of the tank 1.

Figure 3:
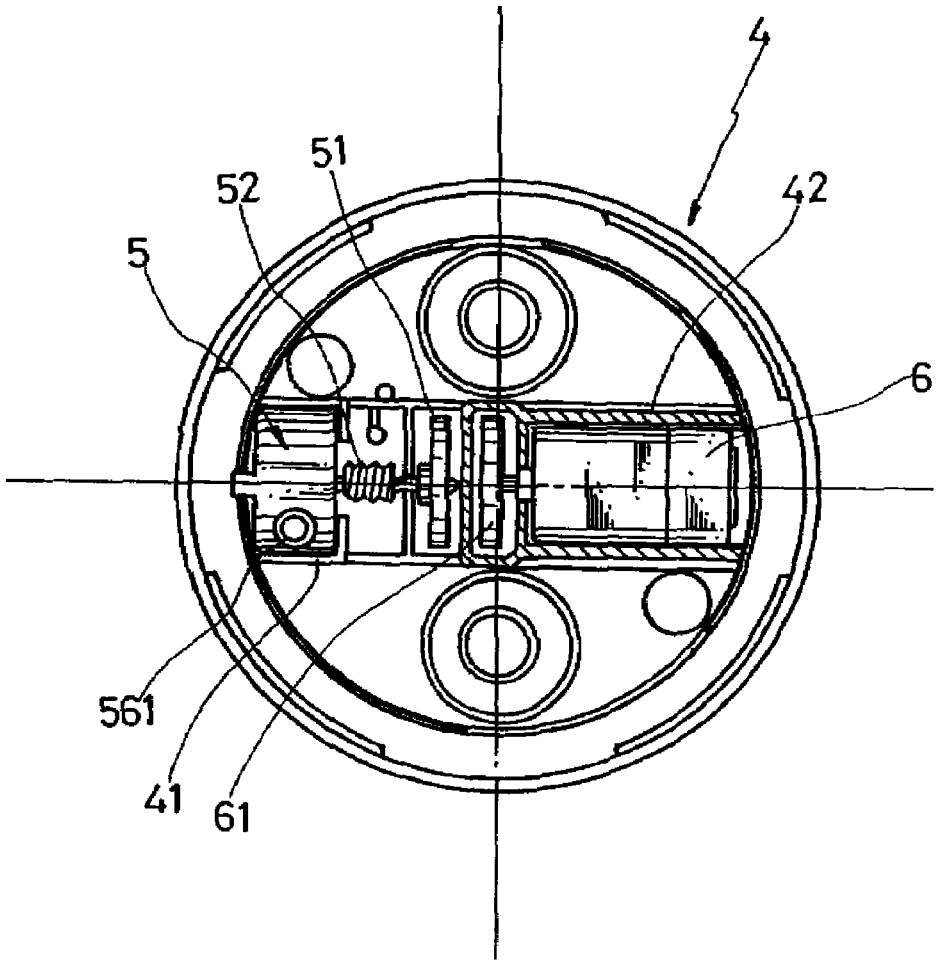
FIG. 3 is a schematic diagram showing the top and bottom halves of the partitioning platform of the musical water tank of FIG. 1 from a perpendicular perspective.

As also shown in FIG. 3, the partitioning platform 4 has an H-like cross-section with a top half open towards the tank 1 and a bottom half open towards the base 7, completely and physically insulated from each other. In the top half, there is a first chamber 41 concaved towards the bottom half for the accommodation of a pump member 5 and, in the bottom half, there is a second chamber 42 concaved towards the top half for the accommodation of a driving member (including a motor 6 and a first coupling disc 61). The first and second chambers 41 and 42 are aligned so that the pump member 5 and the driving member are positioned in an axially end-to-end manner.

The center of the first coupling disc 61 of the driving member is perpendicularly joined to a front end of the axle of the motor 6. Therefore the first coupling disc 61 would spin as the motor 6 is turned on.

Figure 6:
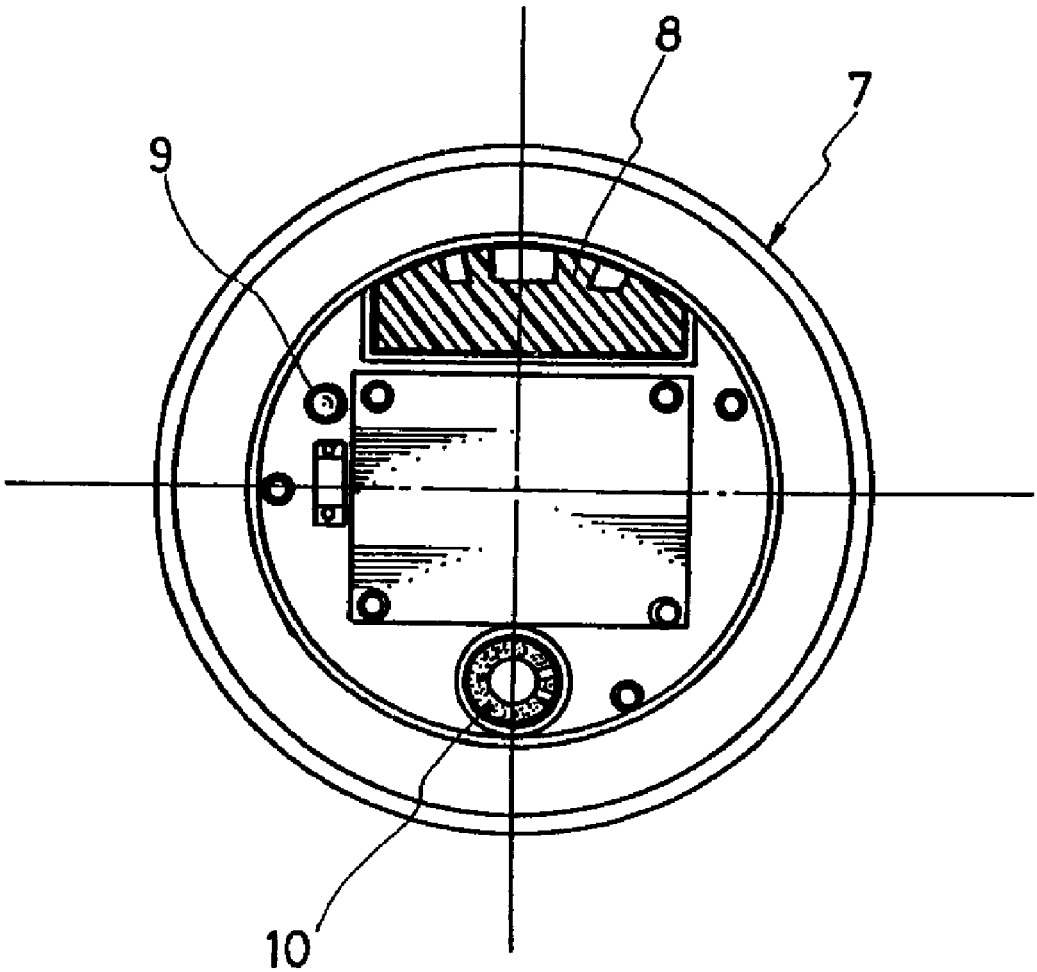
FIG. 6 is a top-view diagram showing the base of the musical water tank of FIG. 1.

As shown in FIG. 6, a control circuit board 8, a light generation element 9, and a speaker 10 are positioned inside the base 7 and beneath the partitioning platform 4. Due to the partitioning platform 4's insulation, the driving member in the bottom half of the partitioning platform 4 and the foregoing components inside the base 7 are completely protected from any possible chance of damage from the fluids 11 and 12 leaked from the tank 1.

The motor 6, the light generation element 9 (such as a light emitting diode), and the speaker 10 are all connected to and controlled by the control circuit board 8. The control circuit board 8 provides flexible, dynamic, synchronized, and rhythmic control of the motor 6's speed, the turning on and off of the light generation element 9, and the sound delivery of the speaker 10, so as to achieve appealing audio and visual effects.

Figure 4:
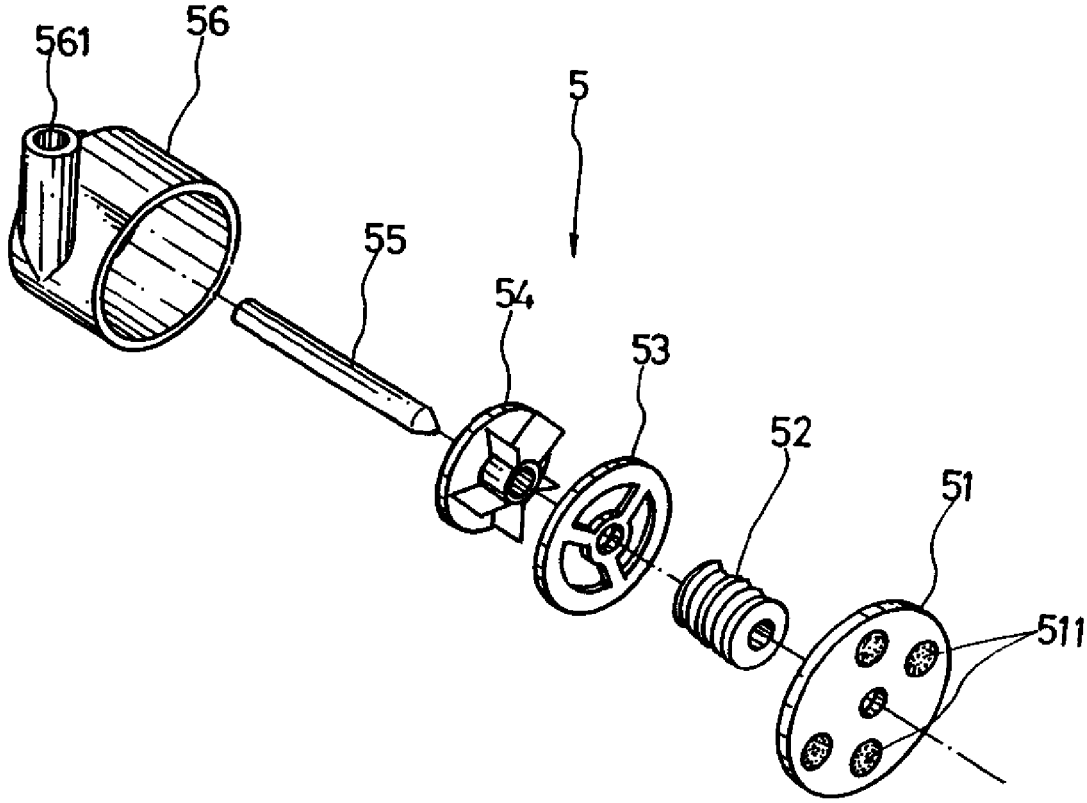
FIG. 4 is a perspective diagram showing the various components of the pump member of the musical water tank of FIG. 1.

As further shown in FIG. 4, the pump member 5 contains an axle 55 threading through a vane wheel 54, a supporting disc 53, a driving gear 52, and a second coupling disc 51, in this order from front to back. The pump member 5 is positioned such that it is axially aligned with the driving member and the first and second coupling discs 61 and 51 are immediately adjacent to each other. On a back surface of the second coupling disc 51, there are a number of second magnetic elements 511. Correspondingly, on a front surface of the first coupling disc 61, there are a number of first magnetic elements (not shown) of a reversed polarity from that of the second magnetic elements 511.

As such, even though the first and second coupling discs 61 and 51 are not in direct contact, the spinning first coupling disc 61 by the motor 6 would engages the second coupling disc 51 to spin as well, through the magnetic force between the first and second magnetic elements. The rotational force of the second coupling disc 51 is then transmitted to the vane wheel 54 via the axle 55, so that the vane wheel 54 spins as well.

The support disc 53 and the vane wheel 54 are housed inside a tubular shell 56. The vane wheel 54 is able to spin freely inside the tubular shell 56 by the support of the support disc 53 and the axle 55. The shell 56 has a tangential outlet pipe 561 pointing upwards so that the heavier fluid 12 sinking to the lower half of the tank 1 would be stirred by vane wheel 56 and, through the guidance of the shell 56, ejected upward out of the outlet pipe 561.

Figure 5:
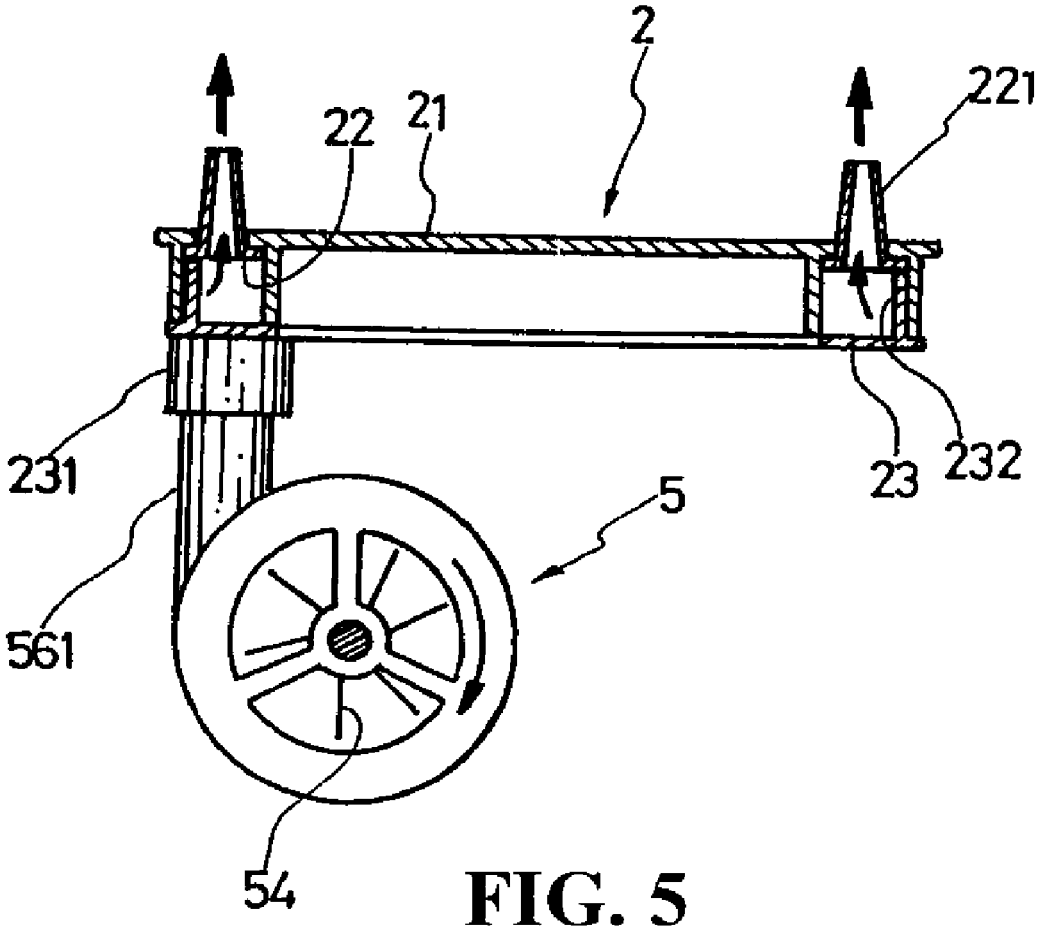
FIG. 5 is a schematic diagram showing the relationship between the pump member and the nozzle member of the musical water tank of FIG. 1.

As shown in FIGS. 2 and 5, the nozzle member 2 contains a circular top cover 21 having a downward extended ring flange and a bottom ring 23 having an upward extended ring flange 232 with a larger diameter than that of the top cover 21's ring flange. The top cover 21 and the bottom ring 23 are joined together to form a closed ring chamber. Within the ring chamber, a nozzle ring 22 is attached to a bottom side of the top cover 21 by the support of the ring flange 232. The top cover 21 has a number of through holes 211 connecting the ring chamber opened upward around the circular circumference of the top cover 21 so as to allow a number of nozzles 221 on a top side of the nozzle ring 22 to penetrate through. On a bottom side of the bottom ring 23, an inlet tube 231 connecting the ring chamber is opened downward to receive the outlet pipe 561 of the pump member 5. As such, the heavier fluid 12 ejected out of the outlet pipe 561 enters the ring chamber via the inlet tube 231, and then is ejected again out of the nozzles 221 and into the tank 1, thereby creating visually appealing streams and bubbles as shown in FIG. 1 to accompany the musical sound delivered from the speaker 10.

Figure 7:
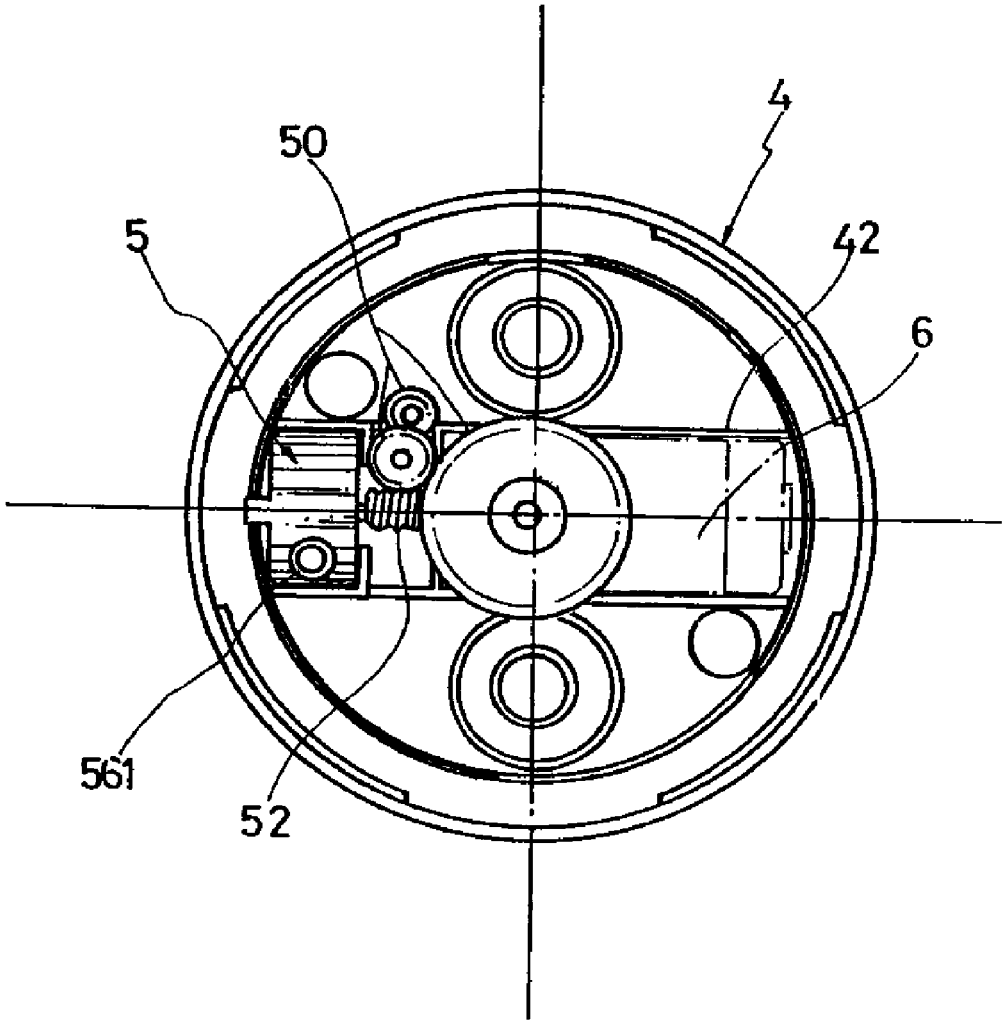
FIG. 7 is a schematic diagram showing the top and bottom halves of the partitioning platform in accordance with another embodiment of the present invention.
Figure 8:
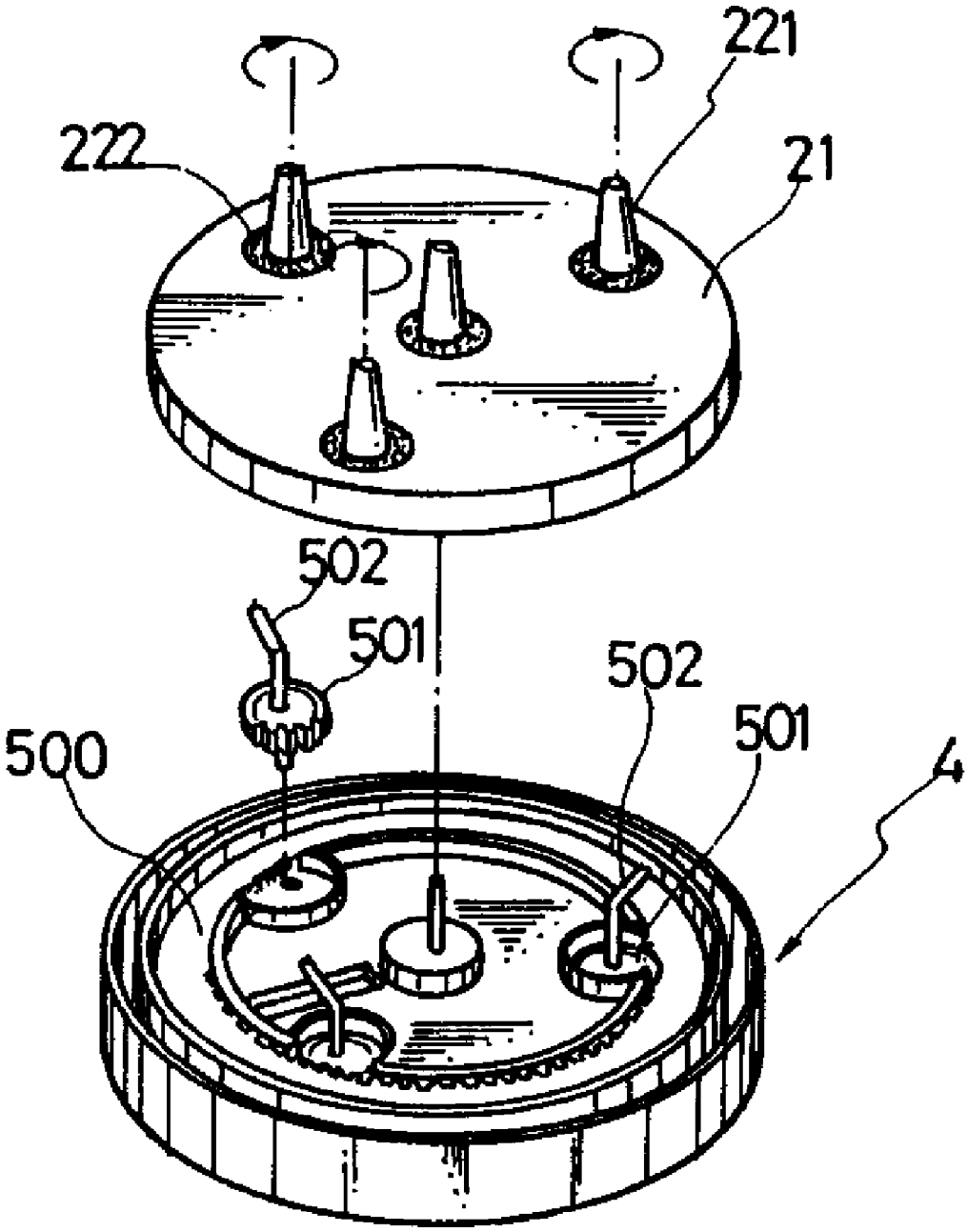
FIG. 8 is perspective diagram showing the engagement of the nozzles by the pump member of the musical water tank of FIG. 7.

As shown in FIGS. 7 and 8, a gear assembly 50 engaged by the driving gear 52 is able to transmit the rotational force of the axle 55 to turn a character inside the tank 1. Additionally, in an alternative embodiment, the gear assembly 50 could further engage a gear wheel 500 which in turn engages a number of smaller transmission gears 501 beneath the nozzles 221, respectively. Each transmission gear 501 has an eccentric axle 502 pointing upward and extending inside a nozzle 221.

In this embodiment, each nozzle 221 is individually and movably joined to the top cover 21 by a flexible ring 222. As such, when the eccentric axle 502 is turned by the transmission gear 501, the nozzle 221 is pushed by the eccentric axle 502 to point to various directions with the allowance of its flexible ring 222. Therefore, the streams and bubbles ejected out of the nozzles 221 are even more dynamic and appealing.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A musical water tank, comprising:

a hollow and transparent tank filled with at least a fluid, said tank having a bottom opening;

a nozzle member having an internal chamber and a plurality of nozzles pointing upwards and connected to said internal chamber;

a washer;

a partitioning platform sealing said bottom opening of said tank with said ring washer and supporting said nozzle member inside said tank, said partitioning platform having physically insulated top and bottom halves;

a hollow base supporting said partitioning platform and said tank, said base containing a control circuit board, a light generation element, and a speaker inside, said light generation element and said speaker connected to and controlled by said control circuit board to provide audio and visual effects;

a driving member in said bottom half of said partitioning platform, said driving member having a motor connected to and controlled by said control circuit board and a first coupling disc perpendicularly at a front end of an axle of said motor; and a pump member in said top half of said partitioning platform having an axle perpendicularly threading through a vane wheel, a driving gear, and a second coupling disc from front to back; said axle of said pump member aligned with said axle of said motor so that said second and first coupling discs are adjacent to each other, said vane wheel housed in a tubular shell having a tangential outlet pipe extending upward into said internal chamber of said nozzle member; wherein said first and second coupling discs' interfacing sides have a plurality of magnetically elements of reversed polarities, respectively, so that, when said first coupling disc is turned by said motor, said second coupling disc is turned as well by magnetic force between said magnetic elements; said axle of said pump motor is turned along with said second coupling disc which in turn drives said vane wheel to spin; and said spinning vane wheel drives a heavier fluid upward into said internal chamber of said nozzle member through said outlet pipe and then to eject out of said nozzles into said tank to create streams and bubbles.

2. The musical water tank according to claim 1, wherein said pump member further comprises a gear assembly engaged by said driving gear to transmit a rotational force to a character inside said tank.

3. The musical water tank according to claim 2, wherein said gear assembly further engages a gear wheel which in turn engages a plurality of transmission gears beneath said nozzles, respectively; each nozzle is joined to said nozzle member by a flexible ring; and each transmission gear has an eccentric axle extended into a nozzle to push said nozzle to point to different directions.

4. The musical water tank according to claim 1, wherein said control circuit board provides synchronized and rhythmic control of said speaker, said motor, and said light generation element.

* * * * *